US009808668B2

(12) United States Patent
Bucher et al.

(10) Patent No.: US 9,808,668 B2
(45) Date of Patent: Nov. 7, 2017

(54) APPARATUS FOR AUTOMATED WALKING TRAINING

(71) Applicant: Hocoma AG, Volketswil (CH)

(72) Inventors: Rainer Bucher, Wettswil a.A. (CH); Konstatin Daremas, Elsau (CH); Adrian Moser, Zollikofen (CH); Lijin Aryananda, Zug (CH)

(73) Assignee: Hocoma AG, Volketswil (CH)

( * ) Notice: Subject to any disclaimer, the term of this patent is extended or adjusted under 35 U.S.C. 154(b) by 51 days.

(21) Appl. No.: 14/899,578

(22) PCT Filed: Jun. 20, 2014

(86) PCT No.: PCT/EP2014/063053

§ 371 (c)(1),
(2) Date: Dec. 18, 2015

(87) PCT Pub. No.: WO2014/202767

PCT Pub. Date: Dec. 24, 2014

(65) Prior Publication Data

US 2016/0136477 A1 May 19, 2016

(30) Foreign Application Priority Data

Jun. 21, 2013 (EP) ..... 13173315

(51) Int. Cl.
*A63B 24/00* (2006.01)
*A63B 22/02* (2006.01)
(Continued)

(52) U.S. Cl.
CPC ..... *A63B 22/02* (2013.01); *A61H 1/0255* (2013.01); *A61H 1/0262* (2013.01); *A61H 3/008* (2013.01);
(Continued)

(58) Field of Classification Search
CPC . A63B 24/00; A63B 24/0062; A63B 24/0087; A63B 22/02; A63B 69/0057;
(Continued)

(56) References Cited

U.S. PATENT DOCUMENTS 5,667,461 A * 9/1997 Hall ..... A61H 1/0229 472/15
6,273,844 B1 * 8/2001 Kelsey ..... A63B 69/0064 482/54
(Continued)

FOREIGN PATENT DOCUMENTS

EP 1137378 A1 10/2001
EP 1586291 B1 4/2008
(Continued)

*Primary Examiner* — Glenn Richman
(74) *Attorney, Agent, or Firm* — The Webb Law Firm

(57) ABSTRACT

An apparatus for automated walking training includes a frame or treadmill having a driven treadmill belt and a pelvis attachment to support a position and weight of a user. The pelvis attachment includes a displacement unit for allowing a movement of the user's pelvis held by attachment elements transverse to and/or rotating about a perpendicular axis to the walking direction of the treadmill to provide a more natural and physiological gait during training. A weight suspension unit having a cable guided over a guide roller positioned above and attached to the pelvis attachment may include a displacement unit adapted to move the guide roller perpendicular to the diverted section of the cable to influence the transverse position of an upper body of the user as well as to prevent a pendulum effect of the trunk of his body.

16 Claims, 11 Drawing Sheets

(51) Int. Cl.

| | |
|---|---|
| ***A63B 69/00*** | (2006.01) |
| ***A61H 1/02*** | (2006.01) |
| ***A61H 3/00*** | (2006.01) |
| ***A63B 21/00*** | (2006.01) |

(52) U.S. Cl.
CPC .. *A63B 21/00178* (2013.01); *A63B 21/00181* (2013.01); *A63B 22/0235* (2013.01); *A63B 24/0062* (2013.01); *A63B 24/0087* (2013.01); *A63B 69/0057* (2013.01); *A63B 69/0064* (2013.01); *A61H 2201/123* (2013.01); *A61H 2201/1207* (2013.01); *A61H 2201/163* (2013.01); *A61H 2201/1642* (2013.01); *A61H 2201/1652* (2013.01); *A61H 2201/5061* (2013.01); *A61H 2201/5064* (2013.01); *A63B 2220/10* (2013.01); *A63B 2220/51* (2013.01)

(58) Field of Classification Search
CPC ..... A63B 69/0064; A63B 2220/10; A63B 2220/51; A63B 2201/1207; A63B 2201/123; A63B 2201/163; A63B 2201/1642; A63B 2201/1652; A63B 2201/5061; A63B 2201/5064
See application file for complete search history.

(56) References Cited

U.S. PATENT DOCUMENTS

| | | | | |
|---|---|---|---|---|
| 6,436,009 | B1 * | 8/2002 | Marucci | A63B 22/02 482/51 |
| 7,381,163 | B2 * | 6/2008 | Gordon | A63B 22/02 482/69 |
| 2004/0005962 | A1 * | 1/2004 | Borsheim | A63B 22/02 482/54 |
| 2005/0288157 | A1 * | 12/2005 | Santos-Munne | A61H 3/008 482/66 |
| 2006/0281606 | A1 * | 12/2006 | Radow | A63B 22/0235 482/54 |
| 2007/0004567 | A1 | 1/2007 | Shetty et al. | |
| 2007/0270723 | A1 | 11/2007 | Krebs et al. | |
| 2011/0312473 | A1 * | 12/2011 | Chu | A63B 22/0292 482/54 |

FOREIGN PATENT DOCUMENTS

| | | | |
|---|---|---|---|
| EP | 1908442 | A1 | 4/2008 |
| KR | 20130038448 | A | 4/2013 |
| WO | 2010105773 | A1 | 9/2010 |
| WO | 2012178171 | A2 | 12/2012 |

* cited by examiner

APPARATUS FOR AUTOMATED WALKING TRAINING

CROSS-REFERENCE TO RELATED APPLICATIONS

This application is the U.S. national phase of International Application No. PCT/EP2014/063053 filed Jun. 20, 2014, and claims priority to European Patent Application No. 13173315.6 filed Jun. 21, 2013, the disclosures of which are hereby incorporated in their entirety by reference.

TECHNICAL FIELD

The invention relates to an apparatus for automated walking and especially treadmill training according to the following disclosure.

PRIOR ART

From Prior Art several such devices are known using a treadmill belt for walking whereas the user is supported by a weight unloading system and/or where the walking on the treadmill belt is further supported by a leg orthosis or leg brace and the weight of such devices can be relieved through additional weight relieving elements as a parallelogram support frame.

EP 1 137 378 discloses an automatic machine, which is used in treadmill therapy (walking therapy) usable for paraparetic and hemiparetic patients and which automatically guides the legs on the treadmill. Said machine consists of a driven and controlled orthotic device, which guides the legs in a physiological pattern of movement, a treadmill and a relief mechanism. The knee and hip joints of the orthotic device are each provided with a drive. Said orthotic device is stabilized on a treadmill with stabilizing means in such a manner that the patient does not have to keep his/her equilibrium. The orthotic device can be adjusted in height and can be easily adapted to different patients.

Further developments of the relief mechanism relate to a device for adjusting the height and the relief force acting on a weight as disclosed in EP 1 586 291 showing two different cable length adjustment means. One is provided to adjust the length of the cable to define the height of the suspended weight. The other is provided to adjust the length of the cable to define the relief force acting on the suspended weight. Another mechanical solution for the adjustment of the relief force can be found in EP 1 908 442.

WO 2010/105773 A1, KR 2013 0038448 A, WO 2012/178171 A2, U.S. 2007/270723 A1, and U.S. 2007/004567 A1 disclose automated walking/treadmill training devices.

SUMMARY OF THE INVENTION

Based on this prior art it is an object of the invention to improve an apparatus for automated treadmill training with the features of the known devices to better generate the natural gait of a person.

Within prior art documents the weight relief and the pelvis attachment guaranteed the balance of the trained person but did not allow for physiological gait movements in the frontal plane, where the person's center of mass naturally shifts laterally over the stance foot, and in the transverse plane, where the person's pelvic naturally translates and rotates. The capability to shift one's center of mass laterally over the stance foot is crucial for the dynamic balance ability during walking. It is therefore an aim of the present invention to improve the known apparatus for more effective training and higher comfort through physiological gait movements in the frontal and transverse plane, which involves lateral movement and transverse rotation of the legs, pelvic, and trunk.

This object is achieved through the features of the disclosure within the present specification.

An apparatus for automated walking or treadmill training of a user includes a treadmill having a driven treadmill belt, a pelvis attachment to support the position and/or weight of the user and having attachment elements adapted to be connected to the user. The pelvis attachment includes a displacement unit for allowing and or supporting a movement of the pelvis of the user held by the attachment elements transverse to and/or rotating about a perpendicular axis to the walking direction provided by the treadmill to provide a more natural and physiological gait during training. The pelvis is attached to the device in a way, that a movement of the pelvis of a user can be supported in view of different degrees of freedom, e.g. lateral or transversal in view of the walking direction, anterior posterior in view of the walking direction and finally for a rotation around the craniocaudal axis of the person to be trained. Rotation of the pelvis around a horizontal axis perpendicular the walking direction, i.e. a mediolateral axis, occurs during normal physiological walking. It is therefore desirable that the apparatus allows freedom and/or provides support in this movement direction because this may lead to a more physiological movement and therefore may improve training effectiveness and comfort.

In this respect the apparatus for automated walking and/or treadmill training of a user is directed to a relative movement of the feet of the user over "ground". This can be realized with a frame adapted to allow a walking movement of the user in the frame. Within the frame can be the ground and the entire apparatus is rolled with the user through wheels at the frame. The other possibility to effect the relative movement is to provide a treadmill having a driven treadmill belt in the open space of the frame. The displacement unit is provided fixedly relative to the frame. This allows that the displacement unit displaces the user relative to the ground. Preferably, the frame defining the ground includes further frame parts for fixing or securing the displacement unit.

A weight suspension unit having a cable guided over a guide roller positioned above the pelvis attachment opposite to the treadmill and attached to the pelvis attachment can be provided. The weight suspension unit is provided fixedly relative to the frame. This allows a spatially fixed suspension of the user with respect to the frame. The weight suspension unit includes a weight suspension displacement unit adapted to move the guide roller essentially perpendicularly to the direction of the section of the cable that has been diverted. This allows influencing the transverse position of the upper body of the person to be trained. Preferably, the weight suspension unit allows a movement of the guide roller in the plane essentially perpendicular to the diverted section of the cable. Accordingly, the guide roller may be moved along and/or perpendicularly to an axis of the guide roller. This allows natural trunk movements associated with natural and physiological gait of the user, i.e. the position of the upper body parts are to be supported and controlled. Additionally a pendulum effect of the trunk of the user is to be prevented. Also, a change in cable length is reduced. The present solution relies on the geometric configuration of pulleys to minimize the rope length change while actuating the end pulley. The direction of the section of the cable that has been diverted is essentially perpendicular to the walking direction, e.g. if the walking direction is essentially horizontal, the direction of the section of the cable that has been diverted is essentially vertical.

For the purpose of supporting the transverse movement of the user during treadmill and/or walking training, the ideal configuration is an embodiment as depicted in FIG. 1, where the movement direction of the guide roller is horizontal and transverse to the walking direction, the guide roller is adapted to move such as to be essentially above the user.

Further embodiments of the invention are also provided in the disclosure.

The displacement unit can include two guide rails inclined one to another, two guiding sleeves each movable along one associated guide rail and a bar connected and articulated through hinge joints with said guiding sleeves for allowing a combined transverse and rotating movement of the user held by the attachment elements connected to the bar.

The apparatus can further include an orthotic device including at least one orthotic drive for each leg, having at least one cuff for each leg, wherein at least one cuff for each leg is movably attached to a cuff attachment device of the orthotic device for a movement of the respective cuff lateral to the walking direction provided by the treadmill. The orthotic device is secured to the displacement unit. It allows a better contact of user and displacement unit or mill.

The control of actuators and drives for the pelvic movement can be effected by the central control unit of the apparatus and signals from position and force sensors can be used in this respect. The apparatus can also optionally include actuator and sensor for the cuff movements controlled by the control unit.

The apparatus can include a control unit to control the position of carriage and roller of a weight suspension displacement unit based on the gait phase of the user provided by a signal providing directly or indirectly representative for the orientation of the cable between the guide roller and the harness of the user. A directly representative signal would be a sensor signal showing the actual position of the user. An indirect signal is a signal derived from other part of the apparatus, e.g. through knowledge of the position of the orthotic drives or through knowledge of the cable length provided by sensors in the weight relief unit controlling the cable length. The weight suspension displacement unit is therefore controllable in dependence of the gait phase, i.e. is adapts to the change of the actual postural position of the user during the gait phase, i.e. physiological gait movement phase. This allows a more precise movement control, which is more efficient and comfortable for the user.

A method for operating an apparatus according to the invention includes the general steps of positioning the pelvis attachment above the opening of the frame at a predetermined height or above the belt. Then a user is attached to the pelvis attachment. Optionally the user is attached to a weight suspension unit which was then previously provided below the intended position of the user. Optionally an orthotic device is attached to the legs of the user, wherein the orthotic leg device as well as pelvis attachment is preferably attached to a weight relief parallelogram or similar unit behind the user. The pelvis attachment is driven and controlled, optionally the weight suspension unit is driven and controlled and optionally the orthotic device is driven and controlled; preferably all by the same control unit.

Especially the weight suspension unit includes beside the usually length adjustment in view of the walking person the further step of control of the carriage allowing to maintain the roller always above the trunk of the user or in other words, in the middle and in a predetermined distance (=half the space the user takes) in front of the pelvis attachment means. In this respect it possible, but not shown in the drawings to provide a second carriage and a second drive provided perpendicular to the first carriage supporting the roller and which second carriage supports the first carriage so that the roller can also be moved in the walking direction following a forward-and-backward movement of the user. However, this has an effect on the cable length, whereas the first carriage effecting a transverse movement has the effect that the cable length is almost not modified by this displacement and additionally there is almost no force exerted in this direction; only the weight force is applied to this roller.

Known appliances (e.g. the one of U.S. 2007/004567 A1) have large masses that have to be moved during every step of the person. The present invention reduces the masses that have to be moved. According to the present invention, only the guide roller, bearing an drives have to be moved.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF DISCLOSURE

Figure 1:
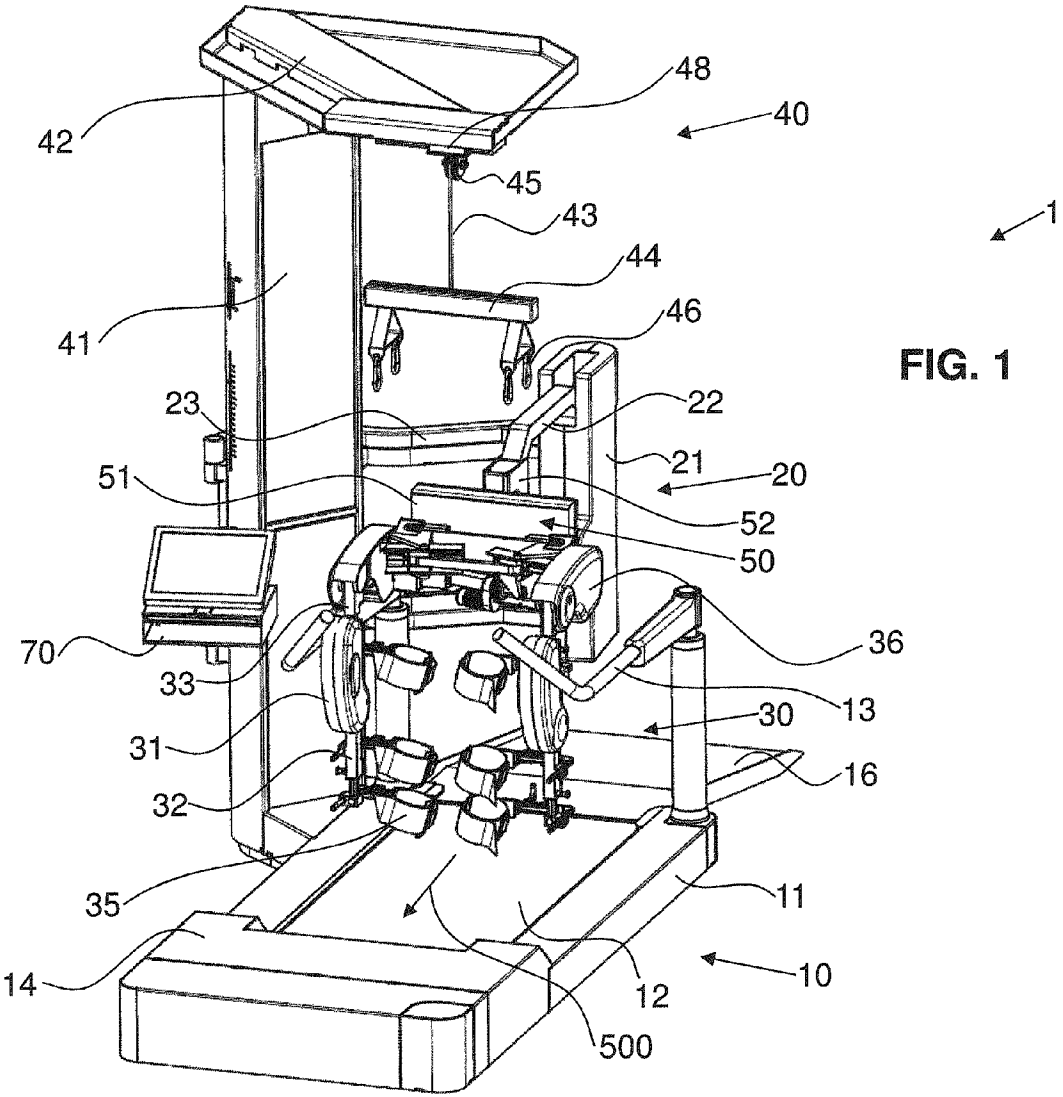
FIG. 1 shows a perspective view of the apparatus including the different improvements according to the invention.

FIG. 1 shows a perspective view of the apparatus including the different improvements according to the invention.

Apparatus 1 includes a treadmill 10 at the base having a treadmill frame 11 to be positioned on the ground. Within the treadmill frame 11 is provided a driven treadmill belt 12 which is adapted to move at various speeds through the action of a drive. The movement of the belt is directed from the front end 14 of the apparatus 1 to the back ramp 16. It is in advantage if two hand rails 13 are provided on the sides of the treadmill belt 12 above the side edges of the treadmill frame 11 in order to be grasped by the hands of a person to be trained 400.

The apparatus 1 for automated walking training can be used as a fixed unit and then especially for treadmill training according to the embodiment shown in FIG. 1. However, the application field of apparatus 1 is also a mobile unit, wherein the frame 11, or a different embodiment with similar function, is mounted on wheels and instead of a treadmill belt, the user 400 walks on and over the ground. Then the apparatus 1 is mobile and moved by the user 400. Then an additional drive can be mounted in connection with the wheels to support the start and the end of any movement or turns and especially to accelerate and brake the entire device and to provide support upon turning.

A support column 41 is attached at the side of the treadmill frame 11. On the support column 41 is mounted a jib 42 being part of the suspension device 40. Within the jib elements is included a suspension roller displacement unit 48. This suspension roller displacement unit 48 includes a roller 45 over which the cable 43 is lead to a cross bar 44 being adapted to support a harness attachment 46. The cable 43 is guided from said harness attachment 46 over roller 45 and further internal rollers and elements within the suspension roller displacement unit 48 into the support column 41 which comprises preferably a device for adjusting the height and relief force acting on the weight of the person to be trained which could be built according to EP 1 586 291 or EP 1 908 442 and which can be provided in the support column 41. Of course also other suspension relief mechanism can be used in this respect. It is further contemplated to use the pelvis attachment 50, as disclosed in the following paragraph on its own, since such a pelvis attachment 50 can include inherently elements adapted to support the position and/or weight of the user 400 to avoid tipping forward, backward and sideward. The stabilization can therefore only rely on a pelvis attachment 50.

The person to be trained is attached to the pelvis attachment 50 which is mounted through two parallelogram arms 22 to the back post 21 which is attached via support arm 23 to the support column 41 and as such to the frame of the apparatus. This parallelogram device can be provided in line with the disclosure of e.g. EP 1 137 378. It is also possible to provide other connection means of the pelvis attachment to the frame apparatus. The only condition to be fulfilled is the stabilization of the position of the pelvis and the tracking of the up- and-down movement of the pelvis during walking action of the user on the treadmill 10.

The person to be trained is attached via a harness (not shown) to the pelvis attachment 50 and the legs of the person to be trained can be put into the cuffs 35 attached via the cuff attachments units 60 with the linkages 32 and 33 of the leg orthosis 30. The leg orthosis 30 is connected to the pelvis attachment back plate 50 and includes beside the mentioned upper linkage 33 and lower linkage 32 on each side, i.e. for each leg of the user, two orthosis drives 31 and 36, an upper hip orthosis drive 36 and a lower knee orthosis drive 31. The leg orthosis 30 is optional; in other words, it is possible to use the pelvis attachment means 50 alone or to use the pelvis attachment means 50 together with the leg orthosis 30; and to combine this use of the pelvis attachment means 50 with the use of the suspension device 40. Finally it is also possible to use the suspension device 40 on its own to provide the mentioned freedom of movement of the trunk of the person to be trained.

Further elements of the devices are shown in the additional drawings. The overall control of the drives according to the various embodiments of the invention can be performed by a control unit 70, which can be a personal computer generating and transmitting all control signals to the different drives of the apparatus 1 and receiving the necessary control information from the drives and additional sensors in order to control the different drives to allow the user 400 to perform actively a walking or running movement or to support the user in such an action through actuating the different drives. Such additional sensors can provide the position of the back plate 51, the position of the bar 53, the position of the roller 45, the inclination of the orthosis elements (provided by the drives 31 and 36) etc.

Figure 3:
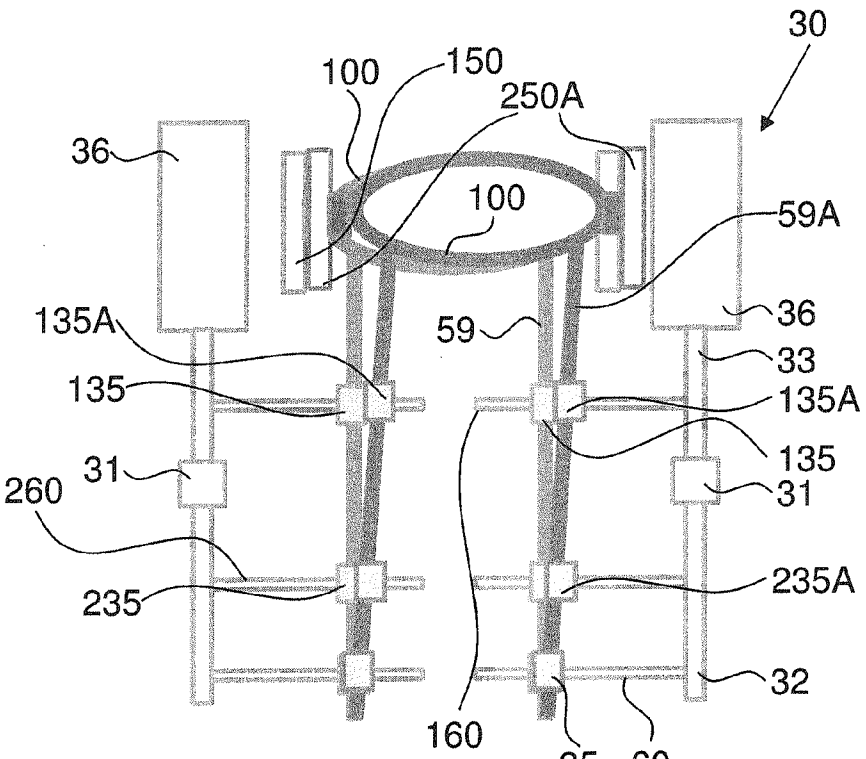
FIG. 3 shows the elements of FIG. 2 in a front elevation view.
Figure 2:
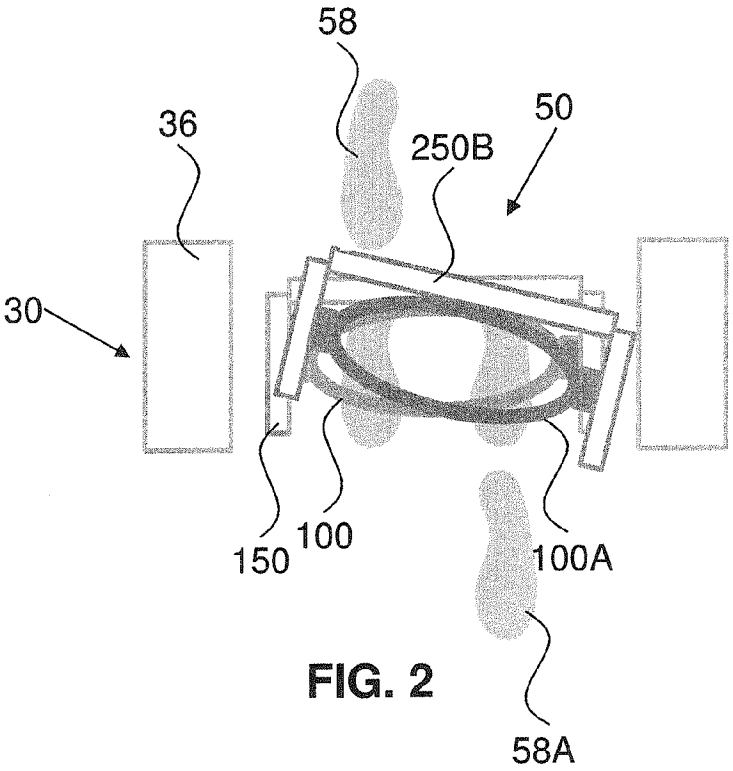
FIG. 2 shows a schematical view from above on a pelvis attachment and leg orthosis way.

FIG. 2 shows a schematical view from above on the pelvis attachment 50 and leg orthosis 30 in a very schematically way. FIG. 3 shows the elements of FIG. 2 in a front elevation view together with a schematical representation of a pelvis 100, 100A and legs 59, 59A of a person to be trained.

Same elements always receive the same reference numerals in all drawings.

FIG. 2 uses a simple box representation for the upper drive 36 of the leg orthosis which is fixedly attached to the back plate 51 of the pelvis attachment. Back plate 51 is attached to the parallelogram device as explained in FIG. 1 in a way known to someone skilled in the art. The pelvis attachment 150 is represented in the vertical unshifted and middle position which is in principal the position as used with a device according to prior art. There said element 150 is attached directly to the back plate 51. According to the embodiment of the invention and in connection with FIGS. 2 and 3 two possibilities, one independent from the other but also jointly usable, are shown.

The pelvis attachment 52 can also be provided in an adjustable way in any direction from bar 53. It is especially an advantage, if the attachment 52 can be positioned and adjusted in the down direction towards the bottom, in combination with a displacement of the leg orthosis in the down direction, which would then allow to make a quick adaption to much shorter users as e.g. children to train on the device.

Figure 4:
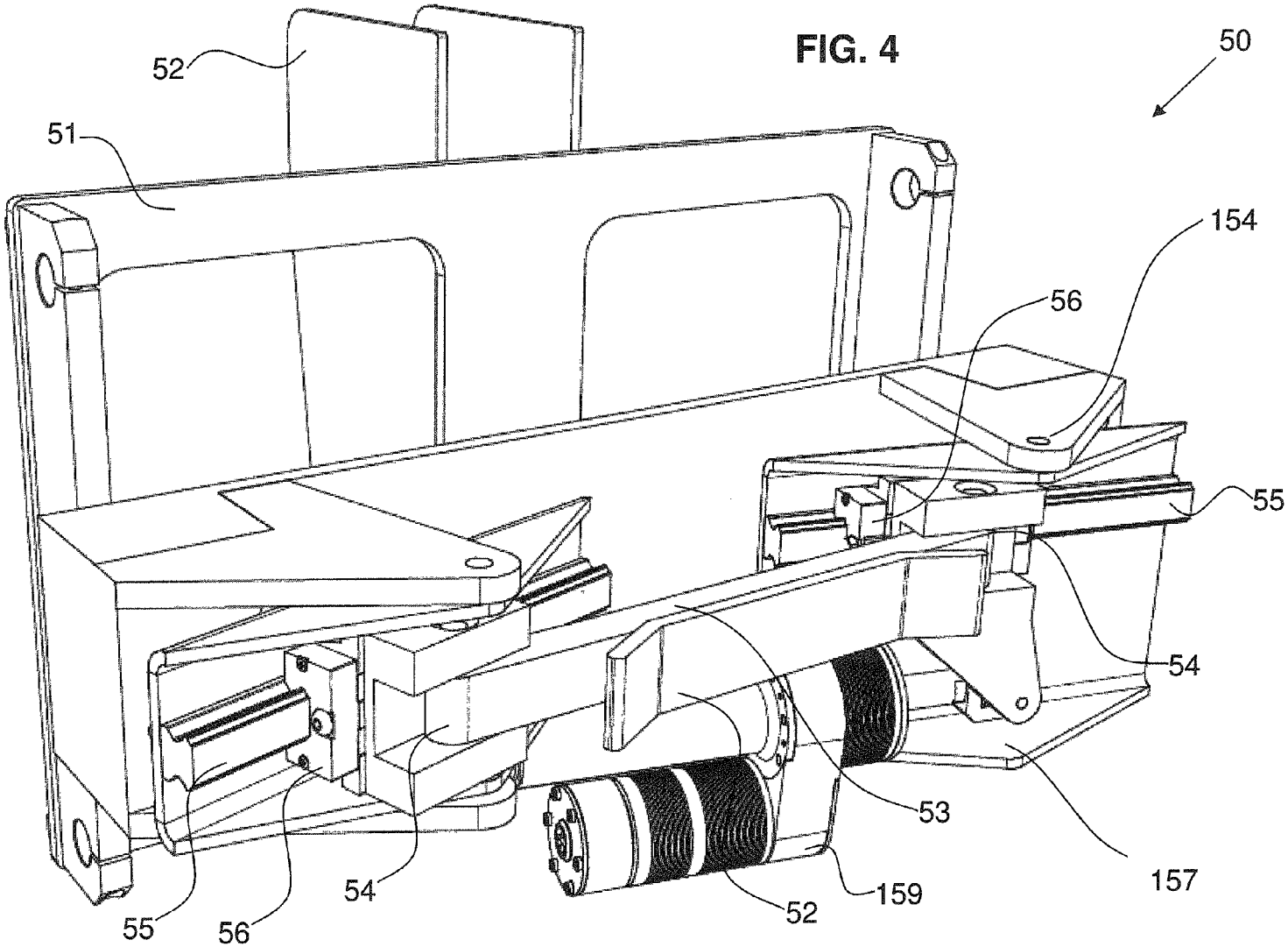
FIG. 4 shows a perspective view from above onto a further pelvis attachment for a combined transversal and rotating movement.
Figure 6:
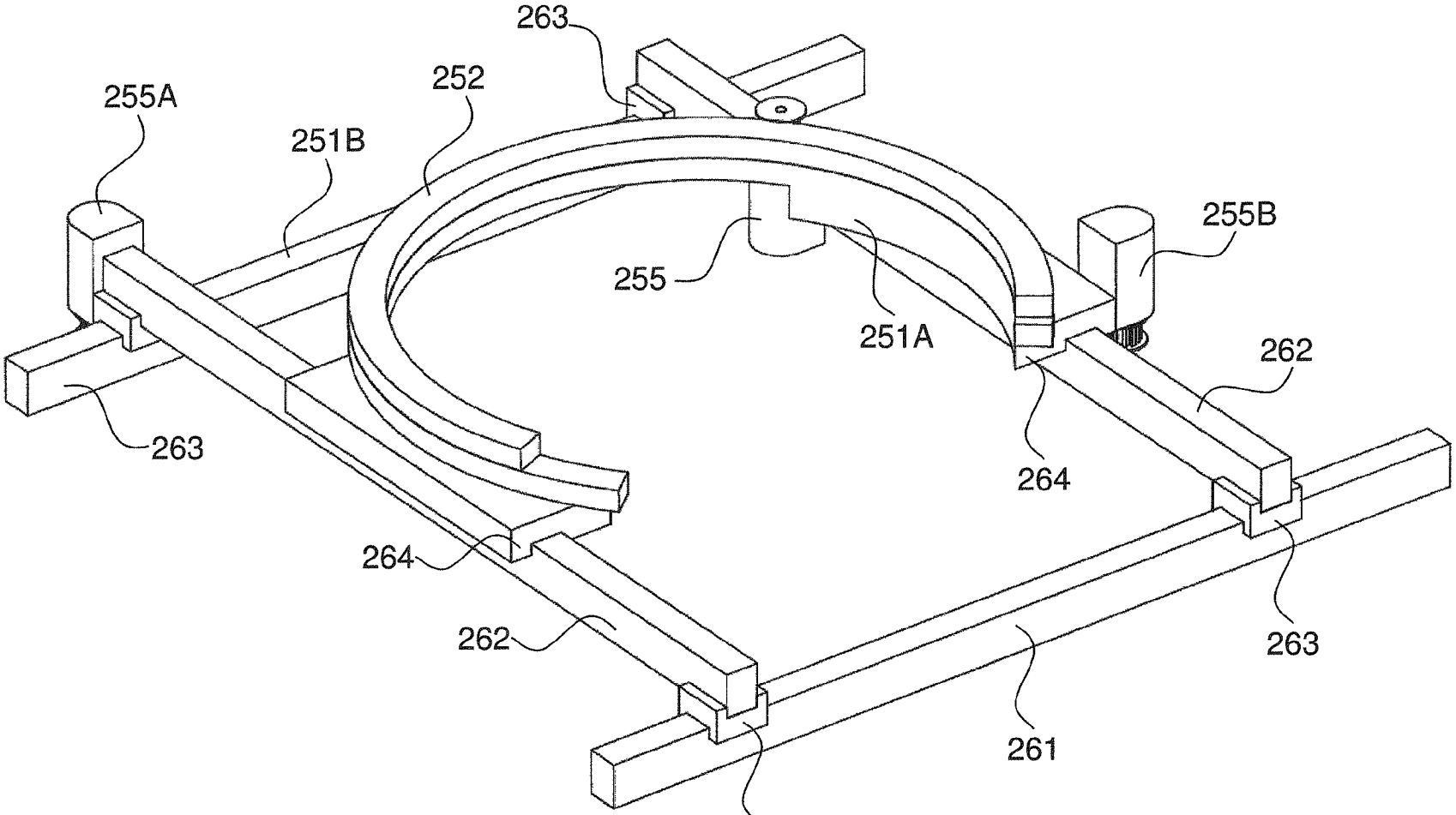
FIG. 6 shows a schematical perspective view on a further pelvis attachment for transversal, rotating and forward movement.

When the user 400 walks on the treadmill 10, his footprints 58 develop on the moving treadmill belt 12 as shown in FIG. 2. Especially, when the left foot is advanced to go into the position of reference numeral 58A, which would then happen on the moving treadmill belt 12 below the user, the pelvis 100 of the user in its normal standing position would turn left around the vertical axis of the human person into the position shown as reference numeral 100*a*. This movement is, in an embodiment according to the invention, possible and acceptable since pelvis attachment 150 can turn around said the vertical axis, i.e. around the axis predominantly given by the hanging cable 43 between roller 45 and harness attachment 46, to take the new position 250B. This is equivalent to turning the elements by a given angle. Such an angle can be chosen between 3 and 30 degrees, more preferably between 5 and 15 and especially between 7 and 10 degrees. Embodiments of a mechanism allowing such a movement are shown in FIG. 4 and FIG. 6. It is also possible that this angle is not a fixed value but can be adjusted according to the needs of the user 400.

Beside allowing this turning of the pelvis attachment around the vertical axis, FIG. 3 shows a further possible embodiment of the movement of the pelvis attachment. Here the pelvis attachment 150 shown in the vertical unshifted position is shifted (in the drawing of FIG. 3) to the right into position 250A which gives a shifted position of the original vertical leg 59 into a inclined leg 59A. It is then possible to realize either to include the turning/pivoting of the pelvis attachment 50 (from position 150 into position 250B as shown in FIG. 2) and/or to only allow the lateral displacement movement of the pelvis attachment 150 (from position 150 into position 250A).

Preferably the shifting movement into position 250A is accompanied by specific cuff attachment units 60, 160 and 260. In these cuff attachment units 60, 160 and 260 the cuff in the original position 35, 135, and 235 can shift along the transverse axis into the position 135A and 235A when the user 400 advances his left leg. On the other hand, when the user then advances his right leg the movement will be inverted and the pelvis attachment 250A as well as the cuffs position 135A and 235A will go beyond the "neutral position" (150/35, 135, 235) into a different inclined position opposite to the position shown in FIG. 3. The inclinations allowed by the movement along the transverse axis 60, 160 and 260 is about 3 to 10 or 15 degrees. An embodiment of such a realization of cuff attachments is shown in the FIGS. 7 and 8.

Cuffs 35, 135 and 235 are attached via cuff attachment units 60, 60 and 260 respectively at pelvis attachment 50. Beside the relative displacement of the cuffs 35, 135 and 235 one to another as usually provided within a leg orthosis for the natural gait movement, they can also move laterally relative one to another as described above.

FIG. 4 shows a perspective view from above onto the pelvis attachment 50 wherein the back plate 151 is realized in a different way compared to back plate 51 of FIG. 1. It is nevertheless fixed to an attachment portion 352 which is linked to the parallelogram arm 22 as shown in FIG. 1.

The pelvis attachment portion 50 includes a pelvis harness belt element 52 which is adapted to be moved through the linkages as explained below. The pelvis harness belt element 52 is attached to bar 53 which is linked through joints 54 via guiding sleeve 56 to two connection links 55. This allows the user, when moving his pelvis 100, to push onto the bar 53 to slide it with the guiding sleeves 56 on the connection link 55 to effect a rotating movement as well as a transversal movement of his pelvis. In order to support the user in training it is possible to provide a drive 159 being connected to the bar 53 in order to move bar 53 and as such the pelvis attachment 50 along the predetermined curve. It is possible to provide adjustment means to change the angle between the two connecting links 55. They are then adjusted in order to vary the movement of the pelvis attachment position 50. If the connecting links 55 are oriented one parallel to the other then only a transverse movement of the pelvis attachment position is possible. In a more general view, the adjustment unit for the connecting links allow adjusting the forced curve defining the movement range of the bar 53 and thus of the pelvis. The movement profile of the displacement unit can then be adjusted to various training scenarios and movement patterns. The inclination of the guide rails 55 is then adjustable, optionally by a drive (not shown) in order to set a relation between lateral travel and transverse rotation. This is realized in the embodiment of FIG. 4 through a pivoting base 157 for each guide rail 55, which can be rotated around turning axis 154 into a predetermined fixed position, e.g. the position shown in FIG. 4.

In order to allow rotation around the mediolateral axis, the pelvis attachment portion 50 may be arranged vertically, i.e. the direction of gravity would be along the bar 53.

The pelvis attachment 52 may be mounted through a passive rotational joint with respect to bar 53. This would allow a user 400 to exert additional transverse rotational movement beyond what the drive 159 provides.

As mentioned above, the pelvis 100 as shown in FIG. 2 is held by an element which is attached to two rails at each end. The attachments are movable on these rails. The rails are provided at an angle. This results in a combined translation and rotation movement of the pelvis. If the user to be trained should be supported more effectively than one or two motor drives 159, especially linear drives, can be provided and apply a force on said element that holds the pelvis to effect and support the movement of this element. Here a force sensor (not shown) can be provided between the harness attachment 52 and the bar 53 to detect any relative movements of the pelvis against the pelvis attachment 50 and then the drive 159 will move the guiding sleeves 56 to bring the forces the user applies to the bar 53 to zero. Here the displacement unit consists of at least one force sensor which measures force interaction with the user 400 and allow for the control unit 70 to provide assist-as-needed control, where the user 400 participates actively to the movement and the actuator provides the remaining work necessary.

Figure 5:
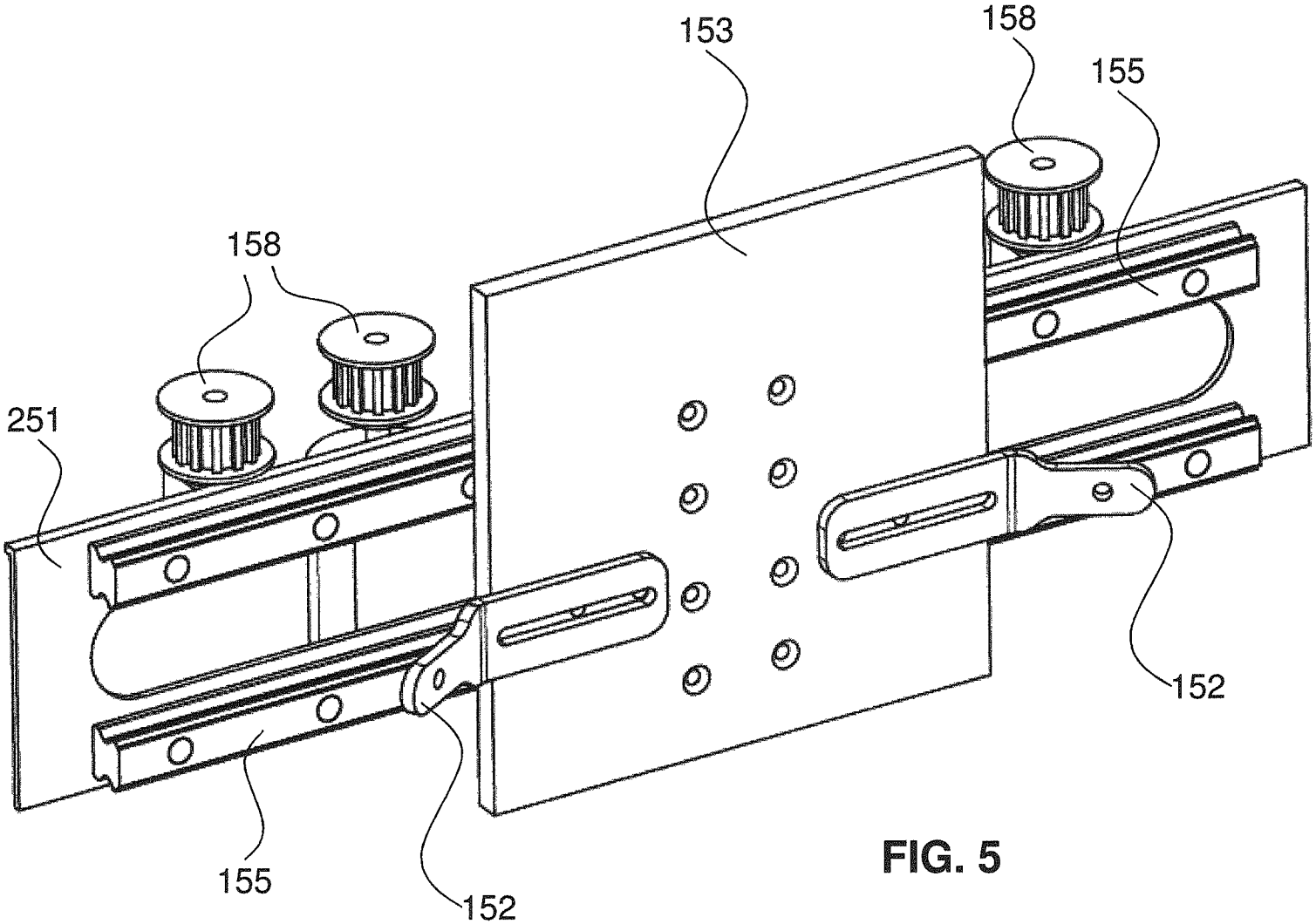
FIG. 5 shows a perspective view on a further pelvis attachment for transversal movement.

FIG. 5 shows a simpler embodiment of the pelvis attachment 50. Here the pelvis harness belt element 52 includes two attachment portions 152 for an attachment to the pelvis 100 of a user. Said attachment portions 152, being similar to the elements 52 of FIG. 4, are attached to a back plate 153 which has on its back side (not visible in FIG. 5) at least one upper and one lower guide sleeve similar to guide sleeves 56 which are gliding on connection links 155 with a dove tail like guiding scheme. The connection links 155 are attached fixedly on back plate 251 which has the same function as the back plates 151 or 51 in FIG. 4 or 1, respectively, and is attached to the parallelogram link. In other words the embodiment according to FIG. 5 simply allows a transversal movement of the pelvis and is therefore preferably in joint use with the cuff attachment portion 60, 160 and 260 according to FIG. 3 and further shown in FIGS. 7 and 8, whereas said device is not adapted to provide a pivoting movement as shown in FIG. 2. Rollers 158 are positioned behind the plate 251. They are part of a belt drive system (not shown), if the plate 153 is to be driven like the bar 53 of the embodiment according to FIG. 4.

FIG. 6 shows a schematical representation of a further embodiment of a pelvis attachment 50 and includes elements for a combined turning and transversal movement. Additionally, a forward movement of the pelvis is also possible.

The pelvis and trunk of the user is positioned inside the %-circle ring 252 including the pelvis attachment portion (not shown). The circle ring 252 can be rotated in view of the underlying ring portion 251A by rotating drive 255. The non-rotatable base element 251A is attached on bearings 264 which are mounted on transverse beams 262 whereas the entire pelvis attachment unit together with the rotating pelvis attachment element 252 can be displaced forward and backward through action of the drive 255B. Beams 262 are mounted on bearings 263 which allow a transverse movement on the front bar 261 and the back bar 251B which have a similar function as back plates 51or151.

The transversal movement is supported through action of the additional drive 255A attached to beam 262. In other words, when the back pelvis attachment bar 251B is attached at e.g. the parallelogram elements 22 according to FIG. 1, then it is possible through action of the motor and transversal drive 255A to move the pelvis attachment 252 in a transversal motion, to move this pelvis attachment portion 252 forward and backward through action of the motor of the drive 255B and to rotate said pelvis attachment portion around the central axis of a user using the apparatus 1 by the drive 255.

Figure 7:
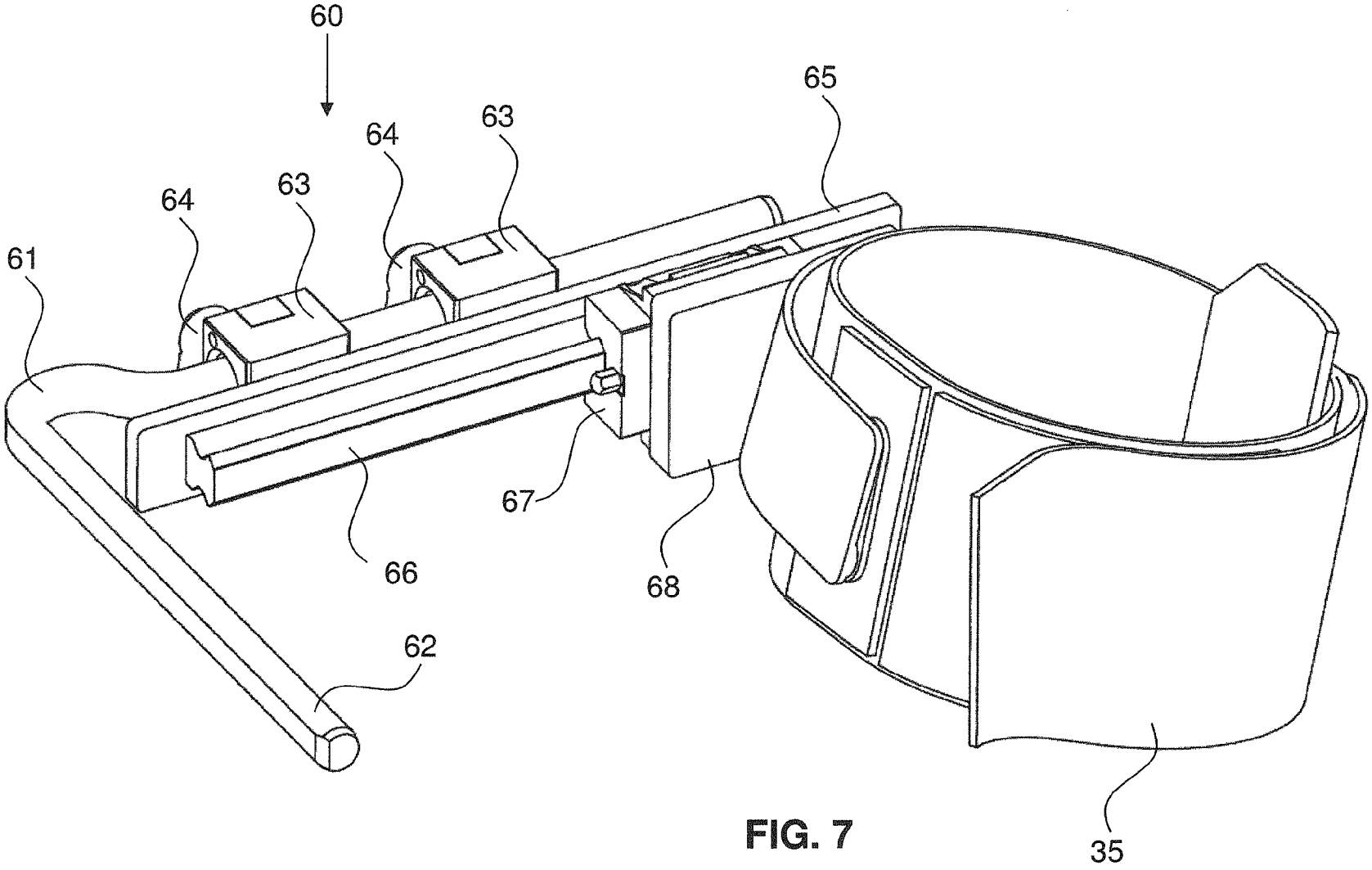
FIG. 7 shows a perspective view of a cuff attachment unit.

FIG. 7 shows a perspective view of a cuff attachment unit 60. The L-shaped bar 61 includes an attachment portion 62 to be affixed at the orthosis linkage e.g. element 32 in FIG. 3. The other arm of the L-shaped bar 61 includes two clamping means 63 which are attached at specific positions along the arm through clamping levers 64.

The clamping means 63 are attached at a base plate 65 on which a linear guide rail 66 including a dovetail portion serves as the bearing for a complementary linear guide car 67 being attached to a cuff plate 68 onto which cuff 35 is provided in a manner known to the man skilled in the art.

Figure 8:
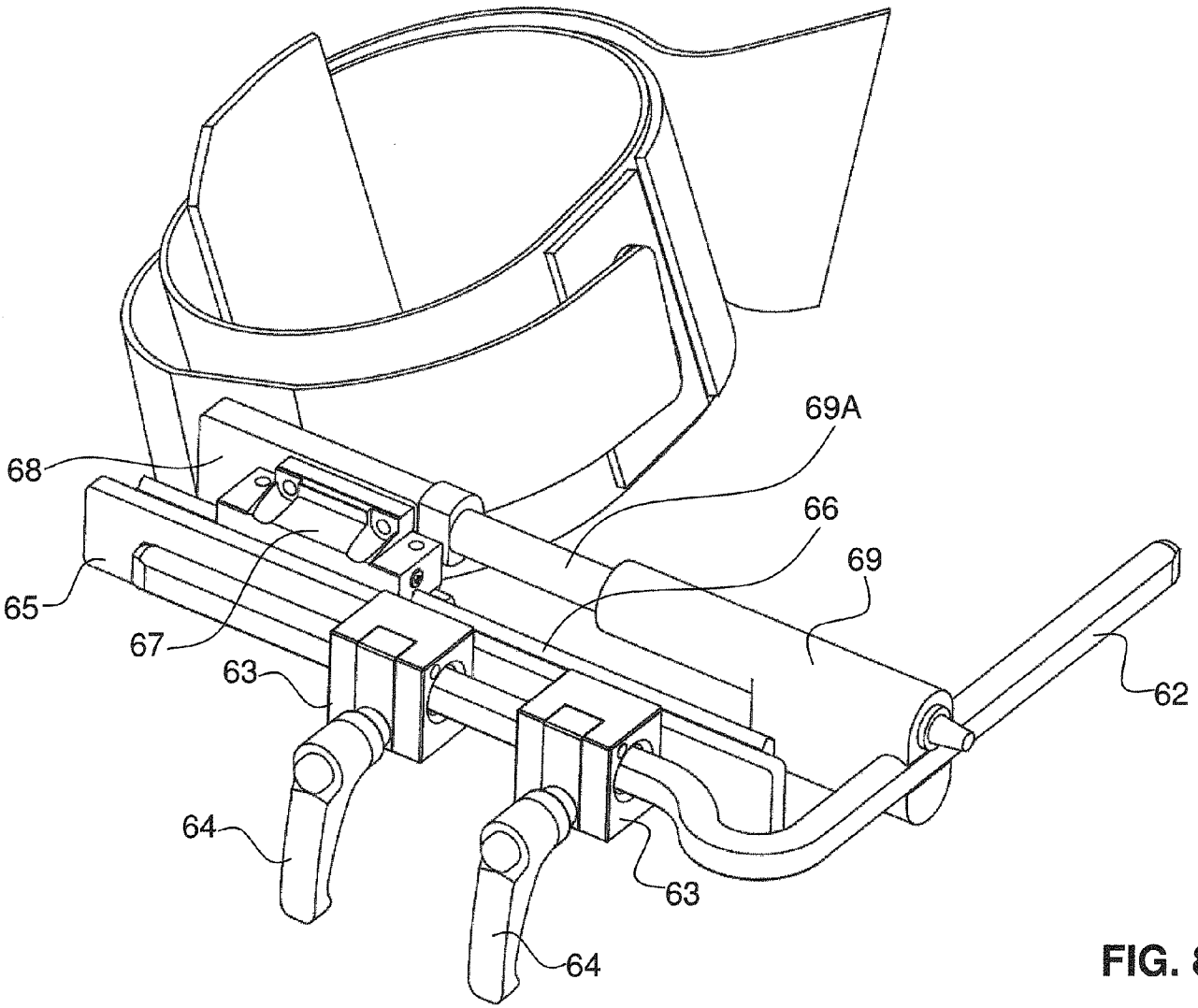
FIG. 8 shows a further cuff attachment unit similar to the unit of FIG. 7 from another angle.

FIG. 8 shows a perspective view of a cuff attachment unit 60 similar to the cuff attachment unit 60 of FIG. 7 from another angle. The difference between the two embodiments is the existence of cuff drive 69 to support the transversal movement of the cuff allowing the control of both foot placement and the inclination of the associated leg. The rod 69A of drive 69 acts as the connection between the bar 62 and the cuff base plate 68.

Therefore, the cuffs are movable which allows the pelvis to move more naturally while keeping the feet of the person to be trained in place. In this respect, keeping the feet of the trained person in place means that the feet are always on or near the same longitudinal line on the treadmill belt 12 independent from the position of the pelvis 100 above the legs 59 and feet. It is an advantage, that the cuff displacement can be added in a simple way to existing orthotic devices.

Figure 9:
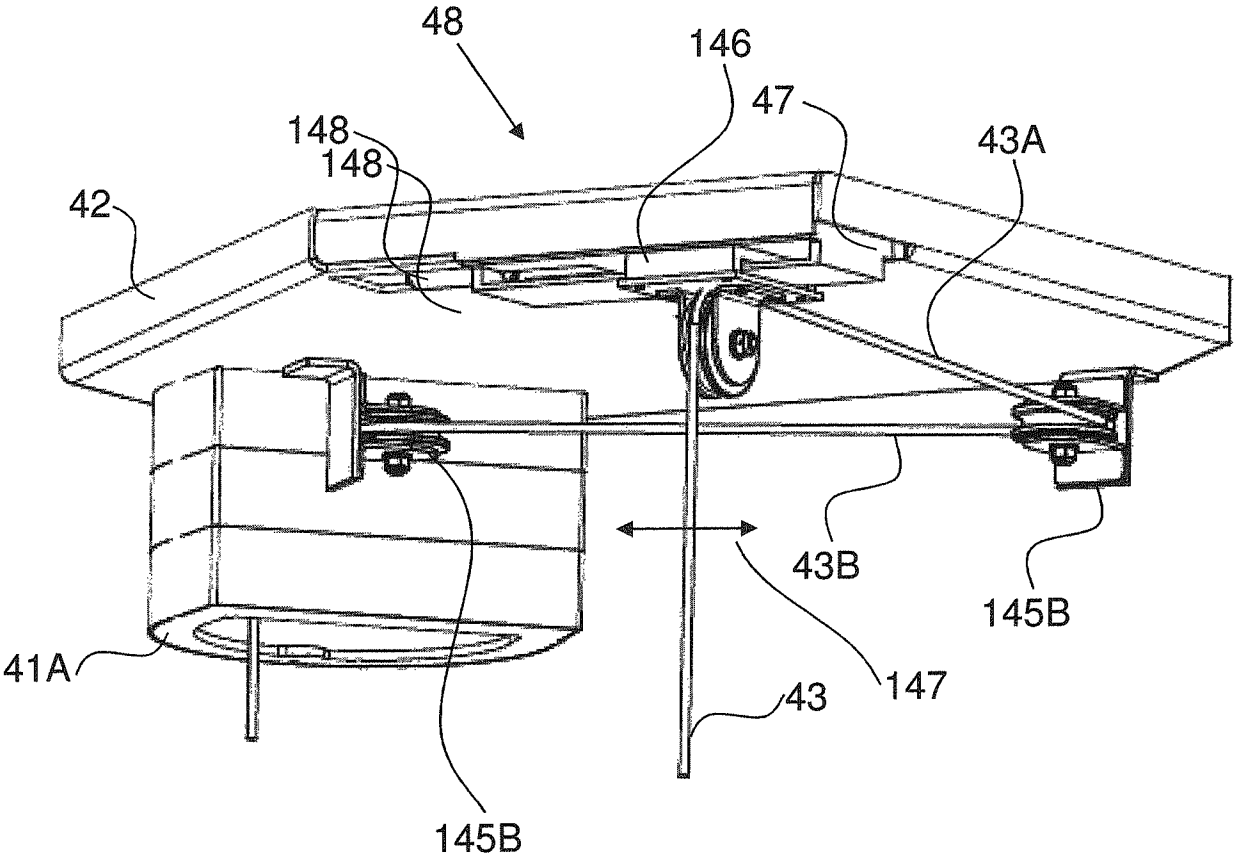
FIG. 9 shows a perspective view from below onto a suspension device.
Figure 10:
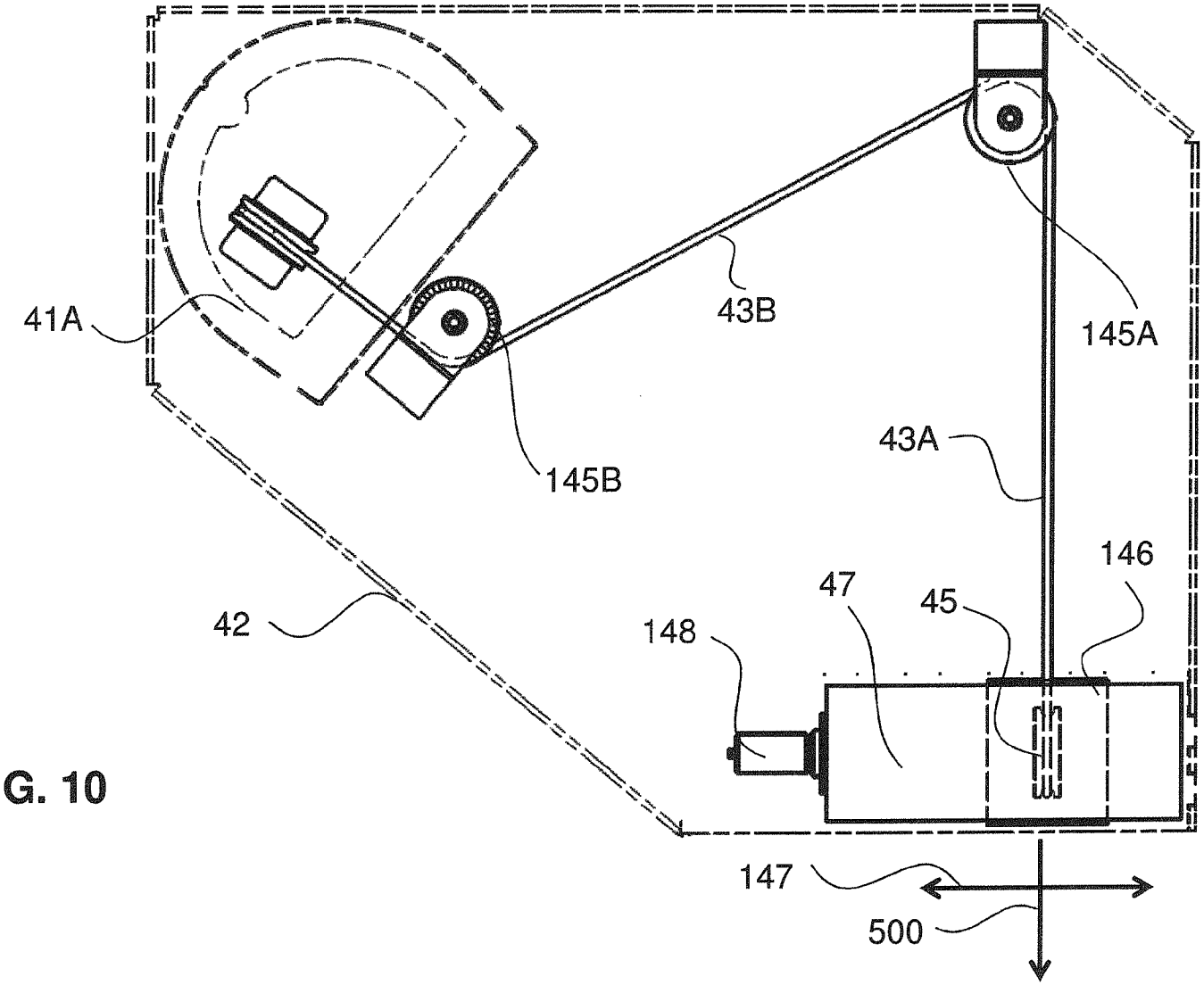
FIG. 10 a view from below on the device according to FIG. 9.
Figure 11:
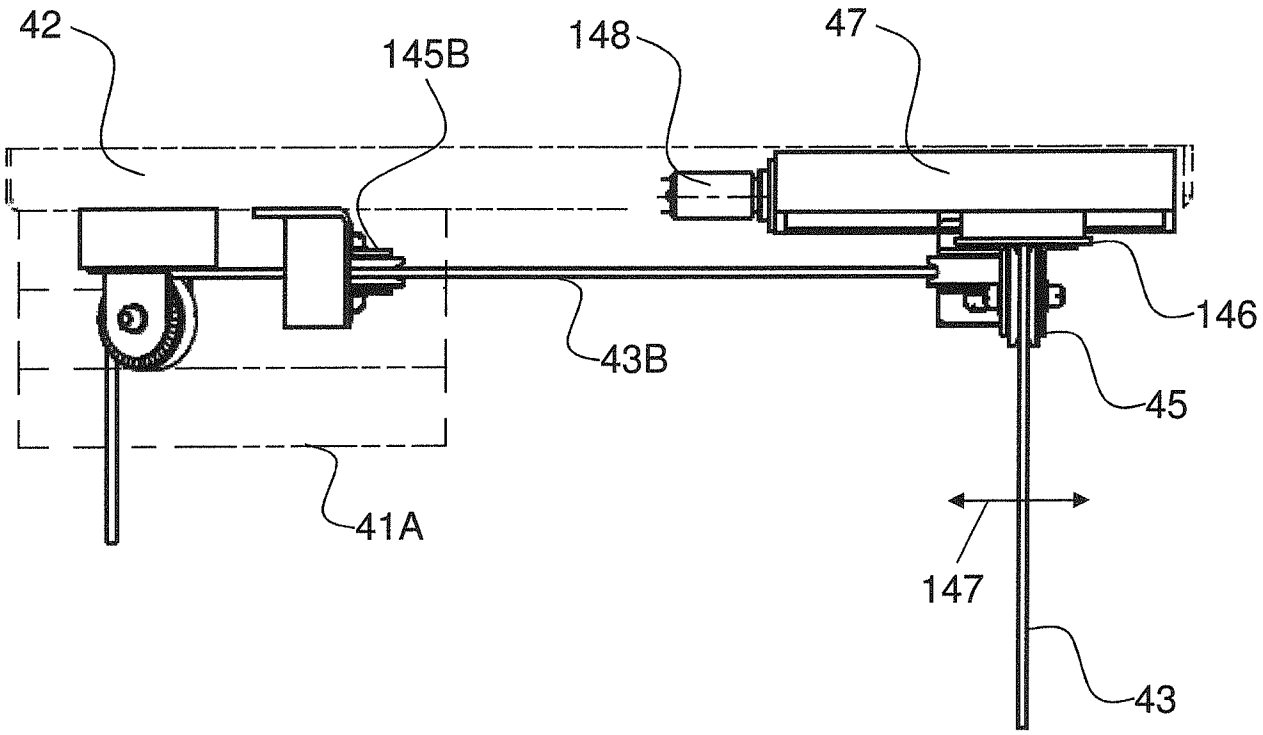
FIG. 11 a side view of the device according to FIG. 9.

FIG. 9 shows a perspective view from below onto the suspension device 40 as shown in FIG. 1. FIG. 10 shows a view from below and FIG. 11 a side view of the jib construction with the suspension device 40 and the displacement structure 48. Under the jib structure 42 is provided the roller 45 positioned on a carriage 146 being supported and transversely gliding on frame 47. Therefore, it is possible to move carriage 146 along double arrow 147 transversal to the movement direction 500 of the treadmill belt 12. The possible transversal movement direction of frame 47 is also oriented in parallel to the axis of roller 45 and perpendicular to cable 43. It is especially possible to provide a drive 148 for effecting this displacement. In a simple embodiment, it is the force of the inclining cable 43 which actuates the gliding movement of the carriage 47. However, in order to guarantee that the roller 45 is always directly above the person to be trained, i.e. the cable 43 is always aligned with the momentary craniocaudal axis of the person when this person effects a left-to-right transversal movement of its upper body while walking, the displacement unit 40 is provided to control the actual position of roller 45 on frame 47. As such it is possible, used in conjunction with the pelvis attachment as shown in FIG. 4 to maintain the roller 45 always above the central axis of the user to be trained. It is also possible to use the suspension unit 48 together with the treadmill 10 without use of the leg orthosis 20 and or the pelvis attachment 50, if these elements are not to be used in the training. Therefore, the suspension unit 48 can be used on its own during treadmill training.

Cable 43 after being turned by roller 45 is then guided as cable portion 43A to a horizontal roller 145A and then as cable portion 43B onto second roller 145B to be diverted into the support column 41 which is shown as the attachment portion 41A in FIG. 5.

This suspension roller drive 40 allows a movement of the user below the roller 45 without involving a slack on cable 43, since the lengths of the cable portion beyond roller 45 down to the user harness bar 44 is only changing through the effect of the up-and-down movement of the upper body of the user which can be compensated by a height compensation device as e.g. shown in EP 1 586 291 or EP 1 908 442. There is no additional change by an inclined cable 43 and there are no additional forces acting on the person through such inclined cable 43 as in the prior art. The transverse movement of the roller 45 on carriage 146 according to arrow 147 only changes the length of the cable portion 43A in a negligible amount. Therefore the impact of this change of length can either be neglected or can be taken into account when providing the control signals for controlling the drive 48 actuating the transversal movement of carriage 146. In other words, the harness holding the person to be trained is (indirectly through the cable) movable by a dedicated drive in order to minimize lateral forces on the trunk of the person to be trained that result from gravity. This is equivalent to say that the driven suspension device 40 prevents a pendulum effect. Furthermore, the driven suspension can also be used to separately control the transverse position of the upper body of the person to be trained. In other words, it is preferred that the middle position of carriage 146 and roller 45 is as shown in FIG. 10, providing a right angle between the movement direction 47 and the orientation of the cable portion 43A. Cable portion 43A is thus oriented in the same direction as the walking direction 500. Any side movements of user 400 therefore only have a small influence on the length change of the cable 43, since the length change is proportional to sin (deviation/length of cable portion 43A) which is roughly the ratio deviation/length of cable portion 43A. Therefore it is preferred to fix roller 145A opposite to carriage 47 as far possible away from roller 45.

Figure 12:
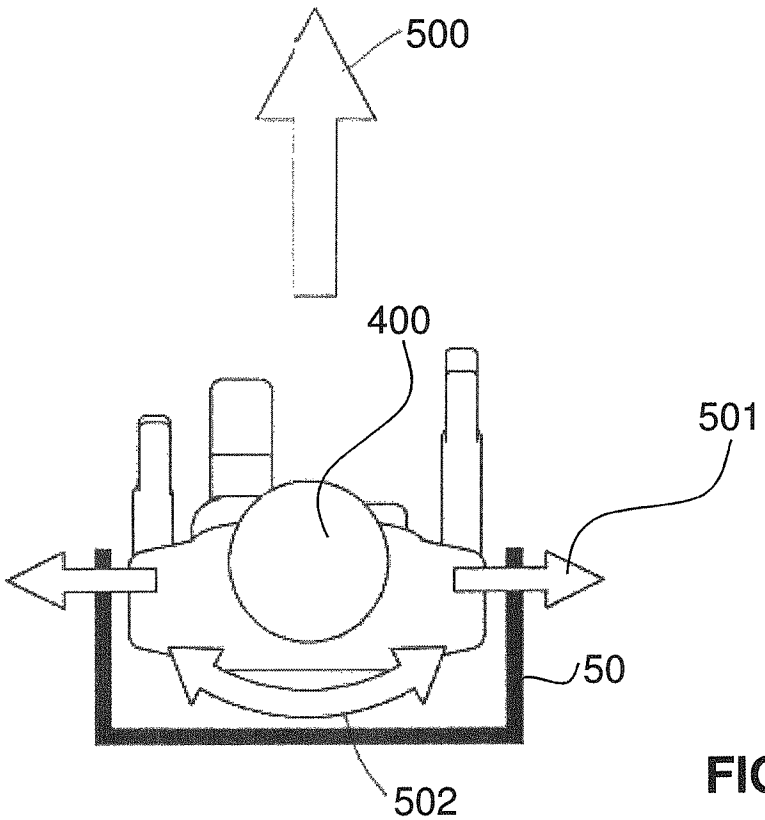
FIG. 12 a schematic view of a person to be trained in a schematically shown pelvis attachment.

FIG. 12 finally provides a schematical view similar to FIGS. 2 and 3 showing a user 400 in pelvis attachment 50 oriented into walking direction 500. Arrow 501 relates to the transverse/lateral movement of the user 400 and arrow 502 relates to the rotational movement. Said movements 501 and 502 can be provided one independent from the other as shown with the embodiment in FIG. 6 and can be provided in a combined manner with a forced curve according to the embodiment in FIG. 4. It is also possible only to provide a rotation or only a transverse movement as with the embodiment in FIG. 5 as well as a forward-backward movement as possible with drive 255B of FIG. 5.

LIST OF REFERENCE SIGNS

| | |
|---|---|
| 1 | device |
| 10 | treadmill |
| 11 | treadmill frame |
| 12 | treadmill belt |
| 13 | hand rail |
| 14 | front end |
| 16 | back ramp |
| 20 | orthosis stabilization |
| 21 | back post |
| 22 | parallelogram arm |
| 30 | orthosis/leg brace |
| 31 | lower orthosis drive |
| 32 | lower orthosis linkage |
| 33 | upper orthosis linkage |
| 35 | cuff |
| 36 | upper orthosis drive |
| 40 | suspension device |
| 41 | support column |
| 41A | attachment support column |
| 42 | jib |
| 43 | cable |
| 43A | cable portion |
| 43B | cable portion |
| 44 | cross bar |
| 45 | roller |
| 46 | harness attachment |
| 47 | frame |
| 48 | weight suspension unit |
| 50 | pelvis attachment |
| 51 | back plate |
| 52 | pelvis harness belt element |
| 53 | bar |
| 54 | joint |
| 55 | connection link |
| 56 | guiding sleeve |

-continued

| LIST OF REFERENCE SIGNS | |
|---|---|
| 58 | foot print, right foot |
| 58A | foot print, advancing left foot |
| 59 | leg, vertical position |
| 59A | leg, shifted position |
| 60 | lower cuff attachment unit |
| 62 | L-shaped bar |
| 63 | clamping means |
| 64 | clamping lever |
| 65 | base plate |
| 66 | linear guide rail |
| 67 | linear guide car |
| 68 | cuff plate |
| 69 | cuff drive |
| 69A | cuff drive rod |
| 70 | control unit |
| 100 | pelvis, vertical unshifted position |
| 100A | pelvis, shifted/turned position |
| 135 | upper cuff, vertical position |
| 135A | upper cuff, shifted position |
| 145A | horizontal roller |
| 145B | second horizontal roller |
| 146 | carriage |
| 147 | arrow |
| 148 | drive |
| 150 | pelvis attachment, vertical position and middle position |
| 151 | back plate |
| 153 | back plate |
| 154 | turning axis |
| 155 | connection link |
| 157 | pivot base |
| 158 | roller |
| 159 | linear drive |
| 160 | upper cuff attachment unit |
| 235 | middle cuff, vertical position |
| 235A | middle cuff, shifted position |
| 250A | pelvis attachment, turned/rotated position |
| 250B | pelvis attachment, shifted position |
| 251A | non-rotating ring portion |
| 251B | back bar |
| 252 | ¾-circle ring; rotating pelvis attachment |
| 255 | rotating drive |
| 255A | additional drive |
| 255B | forward/backward drive |
| 260 | middle cuff attachment unit |
| 261 | front bar |
| 262 | transverse beam |
| 263 | bearing |
| 264 | bearing |
| 352 | pelvis attachment portion |
| 400 | user or person to be trained |
| 500 | walking direction |
| 501 | transverse/lateral movement |
| 502 | rotational movement |

The invention claimed is:

1. An apparatus for automated walking and/or treadmill training of a user comprising: a frame configured to allow a walking movement of the user in the frame, a pelvis attachment to support at least one of a position and weight of the user and having attachment elements configured to be connected to the user, wherein the pelvis attachment comprises a displacement unit for at least one of allowing and supporting a movement of a pelvis of the user held by the attachment elements transverse to, rotating about, or transverse to and rotating about a perpendicular axis to a walking direction, wherein the displacement unit comprises two guide rails inclined one to another, two guiding sleeves each movable along one associated guide rail and a bar connected and articulated through hinge joints with said guiding sleeves for allowing a combined transverse and rotating movement of the user held by the attachment elements connected to the bar.

2. The apparatus according to claim 1, wherein the frame comprises an open space towards the bottom and wheels at an underside or a treadmill having a driven treadmill belt.

3. The apparatus according to claim 1, wherein the displacement unit comprises a lateral displacement unit having guide rails for allowing a movement of the user held by the attachment elements from the group transverse to the walking direction, in the walking direction, or combined transverse and in the walking direction.

4. The apparatus according to claim 1, wherein the displacement unit comprises a rotating displacement unit for allowing a movement of the user held by the attachment elements transverse to the walking direction.

5. The apparatus according to claim 1, wherein an inclination of the guide rails is adjustable.

6. The apparatus according to claim 1, further comprising an orthotic device comprising at least one orthotic drive for each leg, having at least one cuff for each leg, wherein at least one cuff for each leg is movably attached to a cuff attachment device of the orthotic device for a movement of the respective cuff transversal to the walking direction provided by the treadmill.

7. The apparatus according to claim 6, wherein the cuff attachment device comprises a drive for effecting the transverse movement of the associated cuff.

8. The apparatus according to claim 1, further comprising a control unit configured to control drives of at least one of the pelvis attachment and cuff attachment.

9. The apparatus according to claim 1, wherein the frame comprises a treadmill having a driven treadmill belt.

10. The apparatus according to claim 5, wherein the inclination of the guide rails is adjustable by a drive in order to set a relation between lateral travel and transverse rotation.

11. An apparatus for automated treadmill training of a user comprising:

a frame configured to allow a walking movement of the user in the frame, a pelvis attachment to support at least one of a position and weight of the user and having attachment elements configured to be connected to the user, and a weight suspension unit having a cable guided over a guide roller positioned above the pelvis attachment and opposite to the treadmill, wherein the guide roller is configured to divert the cable towards the pelvis attachment, wherein the cable is attached to the pelvis attachment, wherein the weight suspension unit comprises a weight suspension displacement unit that is configured to move the guide roller essentially perpendicularly to a direction of a diverted section of the cable, and wherein the carriage movement is actuated by a drive and the carriage and roller position is controlled by a control unit of the apparatus based on a gait phase of the user provided by a signal providing directly or indirectly representative for an orientation of the cable between the guide roller and the harness of the user.

12. The apparatus according to claim 11, wherein the weight suspension displacement unit comprises a carriage onto which the guide roller is mounted.

13. The apparatus according to claim 12, wherein an axis of the guide roller is mounted parallel to a movement direction of the carriage and the home position of the guide roller is predetermined in a way that a cable portion between the guide roller and the next following roller is in line with the walking direction and at a right angle to the carriage to minimize changes in rope length.

14. The apparatus according to claim 12, wherein the carriage is oriented transverse to a direction of movement of a treadmill belt.

15. A method for operating an apparatus for automated walking and/or treadmill training of a user comprising a frame configured to allow a walking movement of the user in the frame, and a pelvis attachment to support at least one of a position and weight of the user and having attachment elements configured to be connected to the user, wherein the pelvis attachment comprises a displacement unit for at least one of allowing and supporting a movement of a pelvis of the user held by the attachment elements either transverse to, rotating about or transverse to and rotating about a perpendicular axis to the walking direction, wherein the pelvis attachment is positioned above an opening of the frame at a predetermined height, the user is attached to the pelvis attachment, the user is attached to a weight suspension unit, wherein the pelvis attachment is driven and controlled as well as the weight suspension unit is driven and controlled.

16. An apparatus for automated walking and/or treadmill training of a user comprising:

a frame configured to allow a walking movement of the user in the frame;

a pelvis attachment to support at least one of a position and weight of the user and having attachment elements configured to be connected to the user; and one or more sensors from the group of: force sensors relating to forces exerted on the pelvis attachment or cuff attachment, and position sensors configured to deliver position signals of the pelvis attachment or cuff attachment, wherein the pelvis attachment comprises a displacement unit for at least one of allowing and supporting a movement of a pelvis of the user held by the attachment elements transverse to, rotating about, or transverse to and rotating about a perpendicular axis to a walking direction, and wherein the apparatus is provided at least with one force sensor which measures force interaction with the user and allows for the control unit to provide assist-as-needed control, where the user participates actively to the movement and the actuator provides the remaining work necessary.

* * * * *